US006582547B1

(12) United States Patent
Gebekken et al.

(10) Patent No.: US 6,582,547 B1
(45) Date of Patent: Jun. 24, 2003

(54) METHOD OF PREPARING FOR A SPLICE

(75) Inventors: Bernhard Gebekken, Hamburg; Thomas Gassner, Heidgraben; Günter Aster, Hamburg, all of (DE)

(73) Assignee: tesa AG, Hamburg (DE)

( * ) Notice: Subject to any disclaimer, the term of this patent is extended or adjusted under 35 U.S.C. 154(b) by 0 days.

(21) Appl. No.: 09/550,922

(22) Filed: Apr. 17, 2000

(30) Foreign Application Priority Data

Apr. 22, 1999 (DE) ..... 199 18 220

(51) Int. Cl.[7] ..... B32B 31/00; B31F 5/06

(52) U.S. Cl. ..... 156/256; 156/267; 156/159; 156/157; 242/553; 242/556.1

(58) Field of Search ..... 156/157, 159, 156/502, 504, 256, 267; 242/551, 553, 555.3, 555.4, 556.1

(56) References Cited

U.S. PATENT DOCUMENTS 2,089,469 A * 8/1937 Dix ..... 156/157
3,520,748 A * 7/1970 Riegger ..... 156/159
3,533,891 A * 10/1970 Puyear ..... 156/159
4,802,632 A 2/1989 Fukuda et al. ..... 242/58.5
5,322,230 A * 6/1994 Dylla et al. ..... 156/504
5,692,699 A * 12/1997 Weirauch et al. ..... 242/556.1
5,901,919 A * 5/1999 Wienberg ..... 242/556.1
5,916,651 A * 6/1999 Wienberg et al. ..... 242/556
5,996,927 A * 12/1999 Weirauch et al. ..... 156/504

* cited by examiner

*Primary Examiner*—Mark A. Osele
(74) *Attorney, Agent, or Firm*—Norris McLaughlin & Marcus

(57) ABSTRACT

Method of preparing for a splice, characterized in that a reel (1) is rotatably mounted in a reel holder (2) and a pressure roll (3) is pressed against the reel (1), underneath or at the side of the reel holder (2) and parallel to the axis (4) of the reel (1), by means of a pressure system (5), and separates the upper layers of the reel (1) with a transverse cut (A), whereupon the cut ends (6–10) of the web slip off the circumference of the reel (1) to the left and right as a result of gravity or as a result of slight assistance, so that they now hang down to the right and left of the pressure roll (3).

6 Claims, 1 Drawing Sheet

METHOD OF PREPARING FOR A SPLICE

Figure 1A:
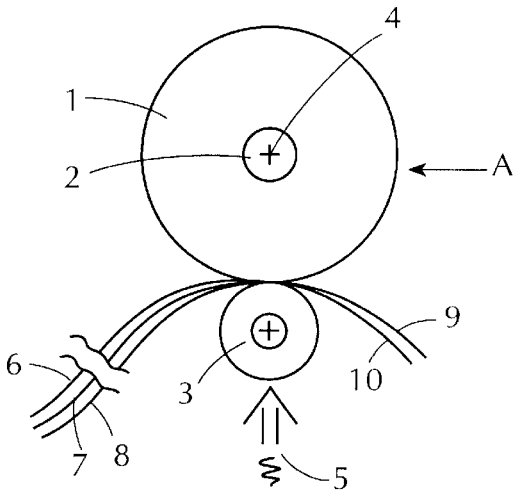

The invention relates to a method of preparing for a splice.

It is known to carry out a splice in order to stick material webs, in particular paper webs, to one another, primarily to stick such webs running at high speed to one another, without the machines having to be stopped in the process. This widespread technique is also referred to as the flying splice or flying reel change.

Adhesive splicing tape specifically suited for this purpose are also known and can be obtained on the market. These double-sided adhesive products, so-called splicing tapes, are generally highly adhesive and tacky, in order to permit a secure adhesive bond in the shortest possible time, and are carefully applied to the reel to be used before the actual splice, occasionally in specific geometries, in order if possible to avoid a break in the high-speed method. Preparation of the reels at rest is also desirable, in order to save the experienced specialist personnel hectic activity on the running machines.

Methods of this type, and specific adhesive splicing tapes for this purpose are known, inter alia from EP 418 527 A2 DE 40 33 900 A1. DE 196 28 317 A1 and DE 196 32 689 A1.

However, the drawback with the previously known products and their use is that it requires considerable experience and skill on the part of the personnel in order that a reel, for example a paper reel weighing several tonnes and having a width up to 8 m, can be prepared uniformly and correctly in this way, in order to ensure a successful flying splice at speeds of several hundred metres per minute. Here, the invention is intended to provide a remedy, with particular regard to the cases in which the new reel to be equipped has damage to its upper layers and firstly has to be "slabbed off", an additional problem which is widespread in practice.

Accordingly, the invention relates to a method of preparing for a splice as is characterized in more detail in the claims.

The particular advantage with this method is that it no longer requires highly qualified personnel to carry it out, and in that the web tension is maintained until the preparation has been completed and the end of the web is present in fixed form. With the method, we make the processing of the reel easier in such a way that, neither during the removal of damaged parts, so-called slabbing off, nor during any other handling of the reel, the application of the adhesive splicing tapes, the pulling off of release papers or release films from the latter, nor during the ultimate fixing of the end of the web onto the adhesive splicing tape, is the tension on the web changed, nor that the slippage of web layers occurs, with corrugations in the material, which can have a disadvantageous effect in particular in the case of paper, since then stress peaks can occur during the actual splice and easily lead to tears, without it having been possible to see this readily in the prepared paper reel.

The method according to the invention proceeds in particular as follows.

A paper reel is rotatably mounted in a reel holder (for example unwind). Underneath or at the side of the reel holder, parallel to the reel axis, there is a pressure roll. The pressure roll can be pressed against the paper reel by means of a pressure system.

The pressure roll is pivoted against the paper reel under slight pressure. The upper paper layers of the paper reel are then severed with a transverse cut. Under the influence of gravity, or with slight assistance, the cut paper ends slip off the circumference of the paper reel to the left and right. The splice tape is applied as prescribed (obliquely, straight, etc.) to the upper, undamaged paper layer. The narrow covering strip is then pulled off the splice tape. As a result of rotation of the paper reel counter to the paper running direction, the paper layer which fell off last is fixed on the splice tape under the web tension maintained by the pressure roll. The pressure roll can now be moved away. The remaining, cut-off paper webs are removed. The paper web fixed by the splice tape is then torn off (cut) exactly at the edge of the still present covering of the splice tape, and the splice preparation is completed.

An adhesive splicing tape which is particularly suitable is one according to DE 196 32689 A1, quite particularly according to DE 19628 317 A1, to which reference is expressly made for further details.

The invention is to be explained further using drawings, but without thereby wishing to restrict it unnecessarily. In the drawings FIGS. 1*a*–1*d* show a schematic illustration of the method in its phases FIG. 2 shows a schematic cross section through an adhesive splicing tape which can be used.

Figure 2:
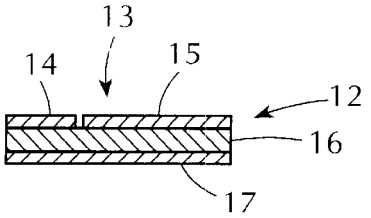

In detail, FIG. 1*a* shows a reel 1, which is rotatably mounted in a reel holder 2. A pressure roll 3 is arranged under the reel 1, parallel to the axis 4 of the reel 1. A pressure system 5 presses the pressure roll 3 against the reel 1. The arrow A indicates that a cut extending transversely across the reel 1 is made in order to remove the upper layers of the reel (to slab them off). The cut-off parts slip off the reel 1 on both sides and then hang over the pressure roll 3.

Figure 1B:
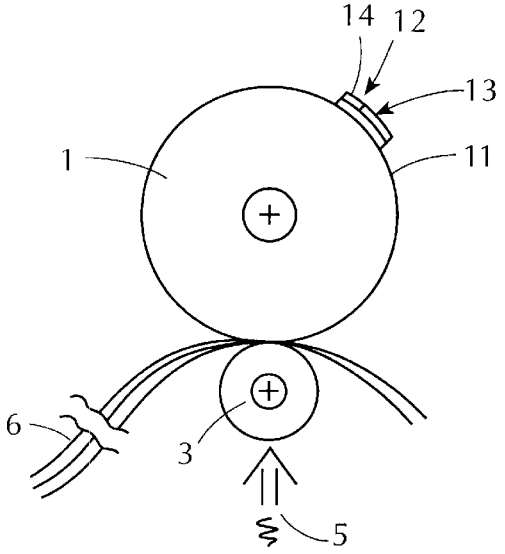

FIG. 1*b* shows that an adhesive splicing tape 12 is stuck transversely onto the reel 1 somewhat higher than the cut made at A. On the outside, the adhesive splicing tape 12 bears a release paper 13, which is divided into two. The upper part 14 is pulled off, that is to say the part which lies closest to the end of the reel, in order that this end subsequently sticks firmly to the exposed adhesive, and the other part 15 of the release paper 13 nevertheless remains accessible. The adhesive splicing tape 12 is therefore stuck on in a region of the reel 1 which can be covered by the end 6 of the web and is also subsequently covered.

Figure 1C:
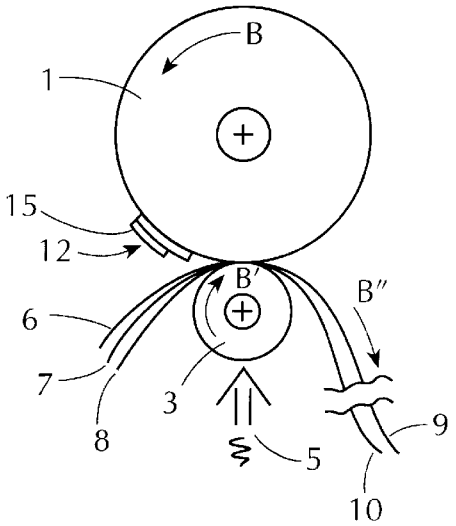
Figure 1D:
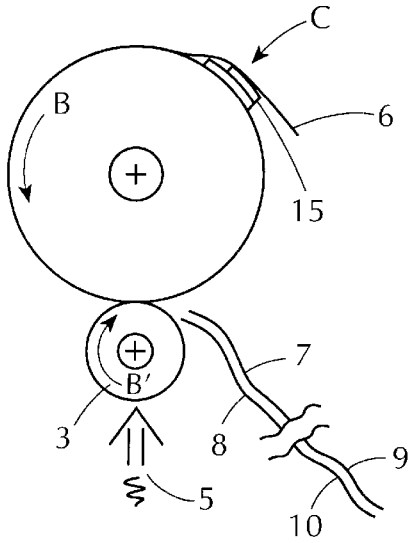

FIG. 1*c* shows, with arrow B, that the reel 1 is then rotated, counter to the running direction of its web, while the pressure roll 3 rotates in the opposite direction, according to arrow B'. In the process, the adhesive splicing tape 12 passes between pressure roll 3 and reel 1, the hanging end 6 of the web being fixed on the adhesive splicing tape 12. At the same time, the web tension is maintained, since the pressure roll 3 continues to be pressed against the reel 1. At the same time, the cut-off ends 7/9 and 8/10 of the web are guided out, as FIG. 1 shows.

The end 6 of the web is torn off or cut off precisely at the edge, so that the end 6 of the web now covers the adhesive of the adhesive splicing tape 12 and ends with the latter, as illustrated by arrow C. All that remains is to pull off the now openly accessible part 15 of the release paper 13 from the adhesive splicing tape 12, in order that the reel 1 is ready for a splice; however, it is also entirely possible for the reel 1 with the part 15 of the release paper not pulled off to be stored, without the adhesive compound being able to be contaminated in this state.

The adhesive splicing tape 12 is illustrated in more detail in FIG. 2, with the release paper 13 in two parts, namely 14 and 15, and release paper 17 on the opposite side (underside). The actual adhesive tape 16 is not broken down in more detail, but in particular comprises a paper substrate with an adhesive compound on both sides, in particular according to DE 196 32 689 A1, or else comprising a laminate according to DE 196 32 689 A1 or a laminate according to DE 196 28 317 A1, that is to say products which split in the paper substrate during the splice, so that the adhesives are covered by the residues of the splitting paper substrate.

What is claimed is:

1. Method of preparing for a splice, characterized in that a) a reel (1) is rotatably mounted in a reel holder (2) and a pressure roll (3) is pressed against the reel (1), underneath or at the side of the reel holder (2) and parallel to the axis (4) of the reel (1), by means of a pressure system (5), and separates the upper layers of the reel (1) with a transverse cut (A), whereupon the cut ends (6–10) of the web slip off the circumference of the reel (1) to the left and right as a result of gravity or as a result of slight assistance, so that they now hang down to the right and left of the pressure roll (3), b) whereupon a double-sided adhesive splicing tape (12) is stuck transversely to the upper, uncut or undamaged web (11) of the reel (1), and from the divided release paper or release film (13) which is located on the rear of the said tape, that part (14) which is arranged at the end of the reel (1) and can be covered by the hanging end (6) of the web on the reel (1) is pulled off, c) then, as a result of rotation (8) of the reel (1) counter to the running direction of its web, the hanging end (6) of the web, as the last layer which has slipped off, is fixed to the adhesive splicing tape (12) under the web tension maintained by the pressure roll (3), d) whereupon the end (6) of the web that is fixed by the adhesive splicing tape (12) is severed exactly at the edge (C) of the second part (15) of the release paper or the release film (13), which is still present.

2. Method according to claim 1, characterized in that the adhesive splicing tape (12) is stuck obliquely across the reel (1).

3. Method according to claim 1, characterized in that the second part (15) of the release paper or the release film (13) is pulled off.

4. Method according to claim 1, characterized in that the pressure roll (3) is moved away after the end (6) of the web has been fixed to the adhesive splicing tape (12).

5. Method according to claim 1, characterized in that the reel (1) used is one made of paper.

6. Method according to claim 1, characterized in that the adhesive splicing tape (12) used is one with a paper substrate.

* * * * *